United States Patent [19]

Larsson

[11] Patent Number: 4,773,569

[45] Date of Patent: Sep. 27, 1988

[54] DISPENSER FOR PASTY MATTER

[75] Inventor: Uno Larsson, Askim, Sweden

[73] Assignee: Unro Teknik AB, Gavle, Sweden

[21] Appl. No.: 908,646

[22] Filed: Sep. 18, 1986

Related U.S. Application Data

[63] Continuation-in-part of Ser. No. 663,416, Oct. 22, 1984, abandoned.

[51] Int. Cl.[4] ..... B67D 3/02

[52] U.S. Cl. ..... 222/181; 222/108; 222/207; 222/453; 222/476

[58] Field of Search ..... 222/108, 181, 207, 213, 222/453, 476, 478, 570, 571, 495, 494, 212, 215, 450–451; 137/312; 141/115–117, 311 A

[56] References Cited

U.S. PATENT DOCUMENTS

| | | | |
|---|---|---|---|
| 2,772,817 | 12/1956 | Jauch | 222/207 |
| 2,898,014 | 8/1959 | Borah | 222/570 X |
| 3,047,195 | 7/1962 | Richmond | 222/570 |
| 3,203,603 | 8/1965 | Benson | 222/494 |
| 3,545,651 | 12/1970 | Lewis | 222/181 |
| 4,243,160 | 1/1981 | Reil | 222/207 X |
| 4,347,875 | 9/1982 | Columbus | 222/108 X |
| 4,498,510 | 2/1985 | Minshew, Jr. et al. | 222/108 X |

FOREIGN PATENT DOCUMENTS 8008366 6/1982 Sweden .

*Primary Examiner*—Joseph J. Rolla
*Assistant Examiner*—Nils E. Pedersen
*Attorney, Agent, or Firm*—Wegner & Bretschneider

[57] ABSTRACT

Mustard, ketchup and similar pasty matter is metered out and served from a dispenser, including a container and an attachable outlet pipe of flexible material enclosing a valve member. The container has one plane end face, permitting it to stand upright during storage, and an opposite, truncated end face, to which the outlet pipe is attached at a threaded portion. A restriction at the truncated end face defines a seat for a valve member, which includes an upper big body and a lower small body interconnected by a rod. The length of this rod is selected so the big body is held mainly inside the threaded container portion, but lower than its seat when the small body rests against the lower end of the outlet pipe.

12 Claims, 5 Drawing Sheets

FIG. 4
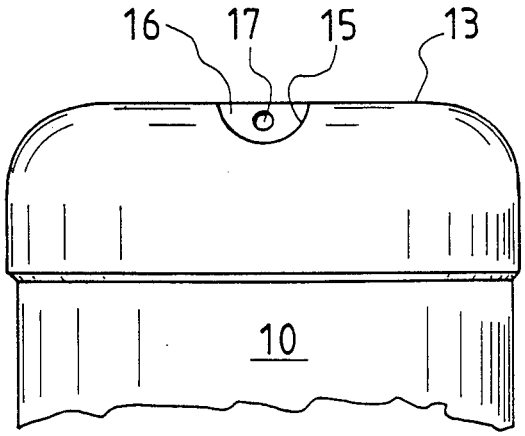
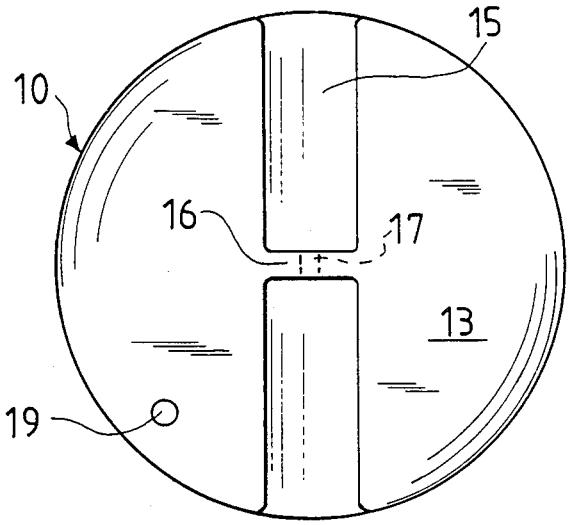
FIG. 5

DISPENSER FOR PASTY MATTER

REFERENCE TO RELATED ART

This is a continuation in part of my copending application 663 416 filed on the Oct. 22, 1984, now abandoned.

BACKGROUND OF THE INVENTION

The present invention relates to a dispenser for fluids, especially pasty matter, the dispenser being of the type comprising an outlet pipe of flexible material, freely dependent from a container and enclosing a valve body.

In restaurant business, large quantities of mustard, ketchup, mayonnaise and similar pasty matters are used which are dispensed whenever a need therefor arises. Especially in coffee shops and similar quick serving facilities, the available space is frequently limited, and the handling of ketchup and mustard stored in plastics containers placed on a table, or shelf, and which have to be upturned each time they are used, is very time-wasting. In addition the containers, as well as its surroundings are easily smeared.

There are several types of containers, which at a neck portion are provided with an outlet pipe of flexible material having some kind of displaceable valve member for opening and closing an outlet for metering and/or discharging the contents of the container.

To save space and time the dispenser can advantageously be suspended with the outlet pipe hanging freely down. The food serving is brought in below the dispenser and the outlet pipe is squeezed until a sufficient quantity of the pasty matter has been delivered.

If the hand squeezing the outlet pipe engages too close to the container, the valve member in the pipe may be locked, which means that the outlet does not open properly and an increased squeezing force is required, causing damage to the outlet pipe and/or the valve member.

One object to the present invention is to propose a design of the engaging ends of container and outlet pipe, so a main part of the valve member obtains a protected position, preventing its being jammed by the hand.

Other objects of the invention will be evident from the following description and drawings.

The container should advantageously be designed as a transport receptacle to be thrown away when empty, only the outlet pipe being retained and transferred from one container to the other. That will however impose certain requirements upon the container - in storage and transport it should be able to stand upright, and its outlet should be closed by some means preventing the content from smearing the seat for the outlet pipe and the threads where the annular member is to be engaged.

SUMMARY OF THE INVENTION

The dispenser comprises a container and an outlet pipe of flexible enclosing a valve member having one big and one small body interconnected by a rod.

The container is defined by a substantially plane end face, as well as a truncated second end face, said second end face terminating in a first, externally threaded neck portion surrounding a first seat for said outlet pipe. Means are provided at said first end face for suspending said container in an upturned position with the engaged outlet pipe extending freely therefrom, and a restriction in the second end face inside of the threaded neck portion forms a second seat for engagement by the big body of the valve member. The outlet pipe has a top flange mating with the first seat, and an outlet opening at its opposite end, internally formed as a third seat for engagement by the small valve member body. The length of the rod of the valve member is sufficient to hold the big body mainly within the threaded neck portion, when the small body rests upon the third seat. An internally threaded annular member, mating with said first threaded portion and having a ledge is adapted to force the top flange against said first threaded portion.

In use the container must be open at its top, and is to that end provided with an indication for punctuation, adjacent to its plane end face.

The flexible outlet pipe has a certain wall thickness, and is just below its top flange provided with an annular groove for engagement with a ledge at the annular member.

The threaded neck portion is inside the first seat provided with an outwardly directed ledge for internally supporting the outlet pipe, and a cup-shaped transport lid is internally threaded to mate with the threaded neck portion, and has an internal annular bead for engaging the ledge.

The threaded neck portion has a substantially uniform wall thickness from the second seat outwards, the big valve member body is spherical and the length of the rod is selected so as to hold the big body with its equator about midway between the first seat and the second seat. A chamber is located within the threaded neck portion and is defined by an inner wall of the threaded neck portion, a radially inwardly turned portion of the first seat, and the second seat. The diameter of the chamber in its widest area is larger than the internal diameter of the adjacent portion of the outlet pipe. Suspending means at said first end face includes a groove running across the end face, having open ends at its margin, and a bracket arranged transversely across the groove, about at the gravity center line of the container the bracket being provided with a hole for engagement by a suspending string.

A dispenser outlet pipe for attachment to the container is advantageously formed as a cylindrical tube of flexible material having first and second ends. There is an outwardly directed flange at the first end for fitting to said container, and the second end includes a first portion, formed as a tapering funnel, internally ending in a seat for the valve body to be enclosed in the pipe. A second tapering portion extends beyond the seat and has an open distal end, the taper angle of this second portion in relation to a longitudinal center line through said pipe being less than the taper angle of said first portion. By cutting this second portion close to the seat, the effective outlet opening may be enlarged.

BRIEF DESCRIPTION OF THE DRAWINGS

FIG. 4 shows an elevation of the top portion of the container, FIG. 5 shows an end view of the top face of the container.

DESCRIPTION

Figure 1:
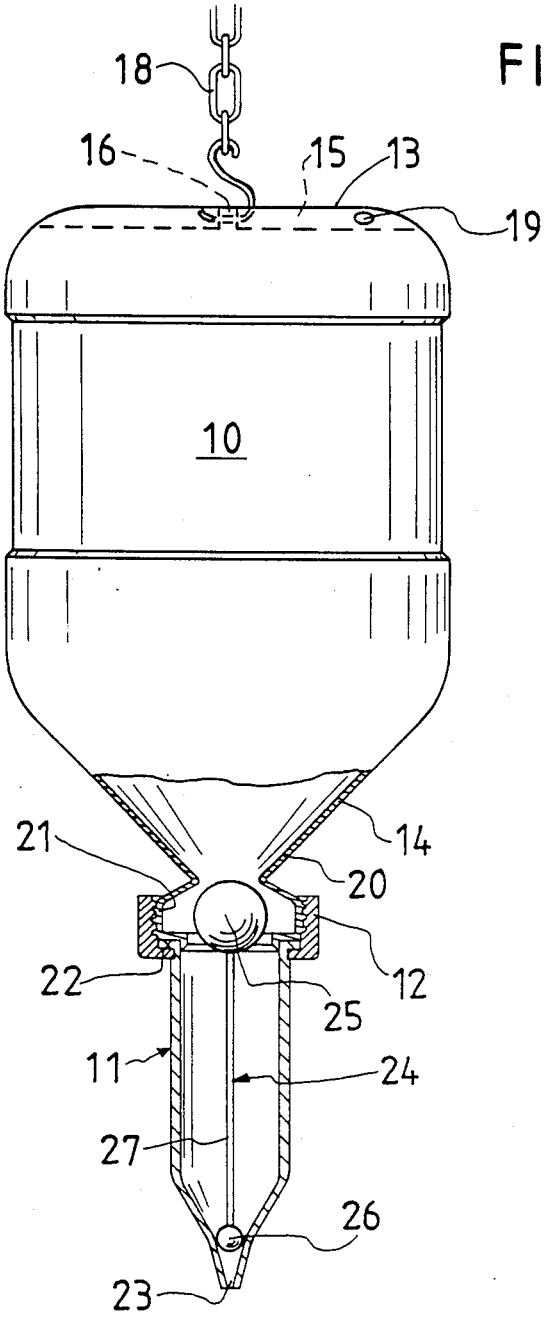
FIG. 1 shows the dispenser, partly cut up, in operating position.

A dispenser according to the invention includes a container 10 and an outlet pipe 11, attachable thereto by means of an annular member 12.

The container 10, which shall serve both as a transport package and a feeding-out store, is an expendable unit, preferable manufactured of plastics. It has advantageously a cylindrical form and is defined by a substantially plane first end face 13 and a truncated second end face 14.

The first end face 13 permits the container to stand with its outlet upwards during storage and transportation. A groove 15 runs diametrically across the first end face, having open ends at its margin. Transversely across the groove, and about at the gravity center line of the container a bracket 16 is provided, not projecting above the otherwise plane surroundings. In the bracket 16 there is a hole 17, in which a suspending string such as a chain 18 may be engaged for hanging the container in an upturned position. The bracket locates the hole centrally in the container, and when suspended by the chain the container can be moved in a horizontal plane with the outlet pipe directed downwards.

Details of the groove and the bracket are evident from FIGS. 4 and 5. The container is preferably produced by a blowing technique, and the groove 15 permits a tool being introduced lengthwise through the groove for punching out the hole in the bracket 16.

During transportation and storage the container will be closed by a lid, as will be explained below. To facilitate the fluid to flow out of the container, as needed, it is necessary to permit air to enter the container. This is therefore, adjacent to the plane first end face 13, provided with a locally thinned spot 19 in the wall material which can easily be punctured, when the container is prepared for use.

The opposite end face 14 is truncated to permit an easy flow even of the pasty matter. The outlet neck 20 of the container is formed with an externally threaded portion 21. A plane annular area 22 inside of the threads forms a seat for the outlet pipe 11. The annular member 12 is internally threaded for engagement with the threaded portion 21.

The outlet pipe 11 is made of flexible material, for instance plastics or rubber, and has an outlet opening 23 at its distal end. The engagement between the outlet pipe 11 and the annular member 12 is better illustrated in FIG. 2.

A valve member 24 is enclosed in the outlet pipe and includes an upper, big body 25 and a lower body 26 of lesser cross section than the first mentioned body 25. The two bodies are interconnected by a rod 27. Both valve bodies are preferably formed as balls.

The second end face 14 is formed with a restriction, or throat 28, inside of the threaded portion 21, forming a seat for the upper valve member body 25.

The length of the valve member rod 27 is selected so as to hold the body 25 mainly inside the threaded portion 21, when the lower body 26 rests at the opening 23 of the outlet pipe. In this position the upper body 25 cannot be gripped by the hand during a squeezing operation.

The horizontal equator 29 of the ball body 25 is located about midway between the seat 22 and the seat 28. In rest position there is thus a flow passage 30 around the upper valve member body 25 to keep the outlet pipe filled.

The container is preferably produced by a blowing technique, which means that the wall thickness in the neck portion will be about uniform. The diameter of the upper valve body 25 is selected so as to permit introduction into the neck portion of the container. The space 31 between the valve body 25 and the threaded portion 21 forms a storage chamber facilitating the filling of the pipe, when the body 25 engages its seat.

The outlet pipe 11 terminates in a truncated portion having the opening 23 at its end. Internally the truncated portion is formed as a seat for the lower, small valve body 26, so dribbling is avoided. Further details of this portion are evident from FIGS. 6 and 7.

In use, the outlet pipe 11 is continously filled with fluid from the container. When the pipe is squeezed by hand the fluid inside the pipe exerts a pressure upon the bigger valve body 25 which is lifted and engages the seat 28. The fluid is then prevented from flowing back into the container, and is forced out through the opening 23.

Figure 2:
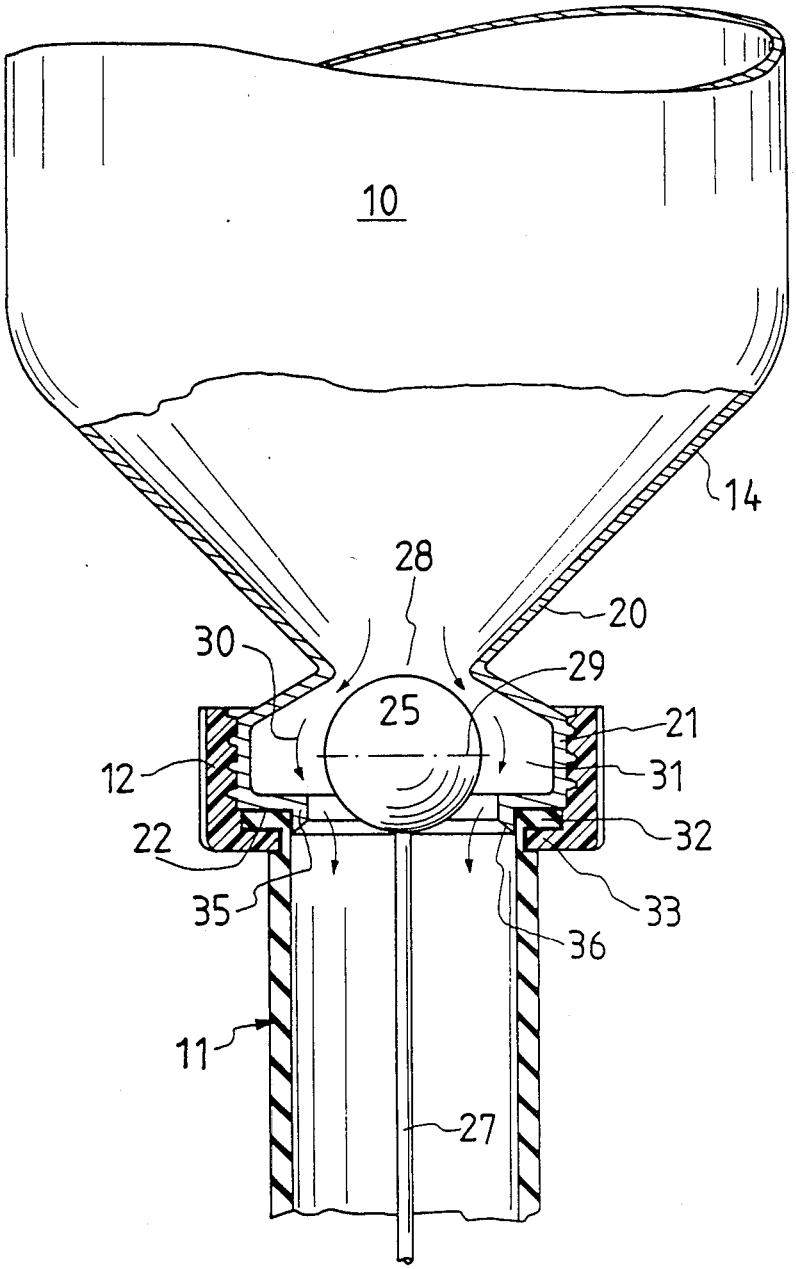
FIG. 2 shows, on a large scale the lower portion of the container and a top portion of the outlet pipe.
Figure 3:
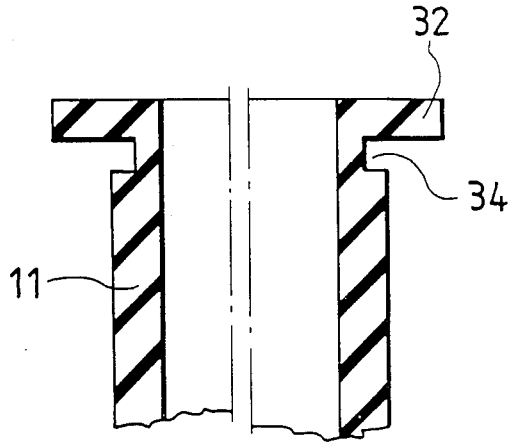
FIG. 3 shows, on still a larger scale, a top portion of the outlet pipe.

The outlet pipe 11 is provided with a top flange 32—see FIGS. 2 and 3—for engagement with the seat 22. The annular member 12 is provided with an inwardly directed ledge 33. To permit the ledge to force as big a portion of the flange 32 as possible against the seat, the envelope wall of the outlet pipe is provided with an annular groove 34 just below the flange 32.

The feature of a flanged outlet pipe and a separate annular member facilitates the mounting and ensures a safe closure.

To secure the outlet pipe 11 in proper position the neck portion of the container, inside the seat 22 is formed with an outwardly directed ledge 35, having the same external diameter as the internal diameter of the outlet pipe 11.

The ledge 35 has an inwardly chamfered edge 36.

Figure 9:
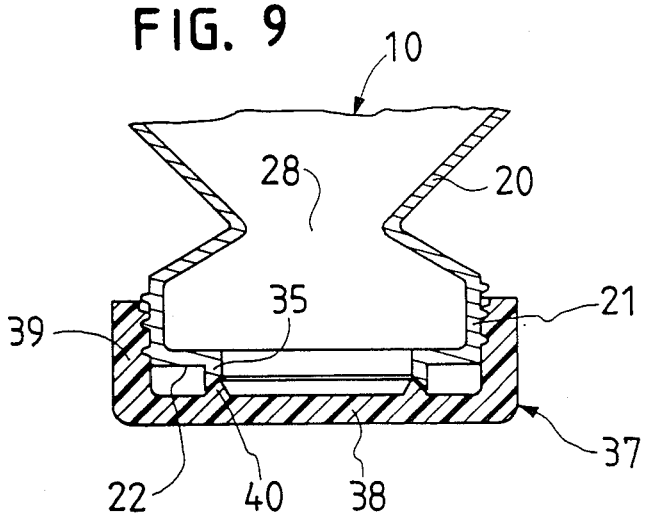
FIG. 9 shows the neck of the container closed by a transportation lid.

As mentioned earlier the container shall also serve during transportation and storage. To that end the neck portion can be closed by a lid 37—see FIG. 9. The lid includes an end wall 38, and an annular side wall 39, which is internally threaded to mate with the threaded portion 21.

The inward face of the end wall 38 is provided with an annular bead 40 which, when the lid 37 is screwed on, engages the chamfered edge of ledge 35.

The engagement between the bead 40 and the ledge 36 prevents the content of the container from smearing the seat 22 as well as the threads 21, making it easy to apply the outlet pipe 11 and the annular member 12 when the lid is removed.

Figure 6:
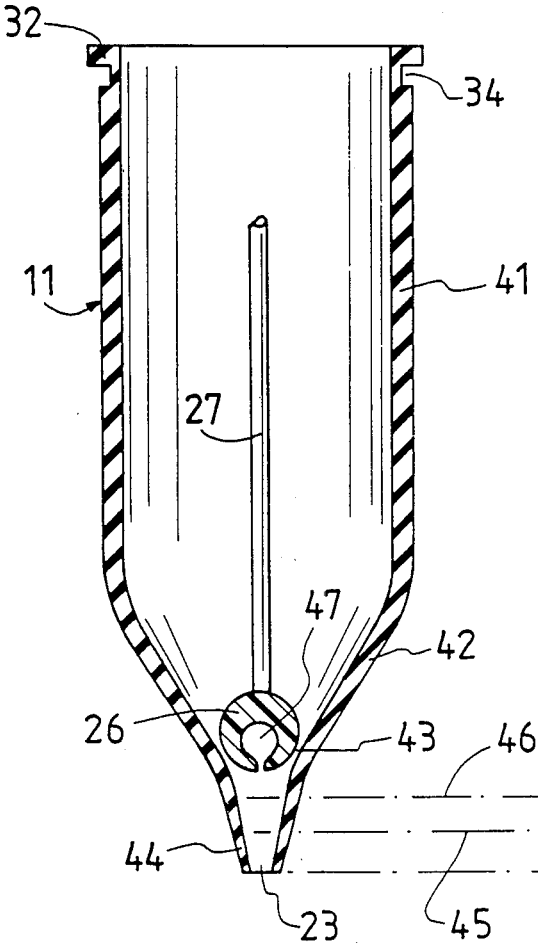
FIG. 6 shows a longitudinal section through an outlet pipe, FIG. 7 schematically indicates variations in outlet openings, obtainable through cutting the end of the pipe.

FIG. 6 shows a longitudinal section through an outlet pipe 11 of preferred design.

The pipe has a tubular main portion 41 of sufficient length to ensure a satisfactory grip below the annular member 12.

The upper end of the pipe is provided with the outwardly directed flange 32, which is downwardly defined by the groove 34, ensuring a satisfactory grip for the annular member 12 described above.

The lower end of the pipe includes a first tapering portion 42, which at its lower end internally forms a seat 43 for the lower valve body 26.

A second, likewise tapering portion 44, extends a distance beyond the seat 43, and terminates in the outlet opening 23.

The dispenser is primarily intended for pasty matter, but may be used with lighter fluids, as well as with heavier fluids, such as various dressings containing chopped onions, pickled gherkings or the like.

The taper angle of the second portion 44 is less than that of the first portion 42, which means that you for a certain length of the second portion can easily determine the desired opening size.

By cutting the second tapering portion 44 at a certain distance from the seat 23, by means of a pair of scissors, or a razor blade, you can obtain an outlet opening of suitable size for the fluid in question.

Figure 7:
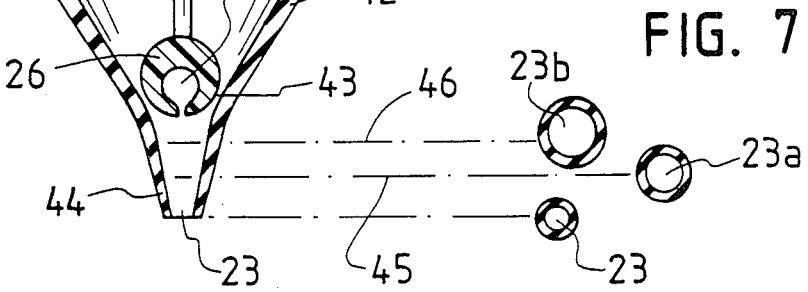
Figure 8:
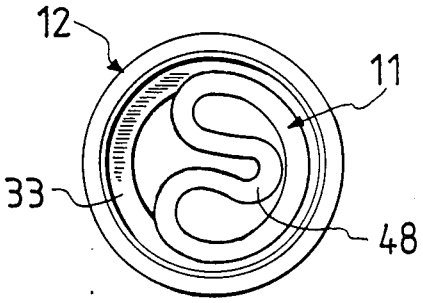
FIG. 8 shows how the flanged end of the pipe is fitted into the enclosing annular member.

In FIG. 7 three different sizes are indicated. The standard opening 23 is used for light fluid. A cut at level 45 will provide an opening **23*a* suited for mustard, and a cut at level 46 will provide an opening 23*b*** suitable for some kind of dressing.

The lower valve body 26 is shown in a vertical section, illustrating an internal cavity 47, which is open downwards. The squeezing out of fluid from the pipe reduces the content of fluid also in the cavity. When the pressure is released, and the body 26 engages its seat, the capillary force will suck in the "last drop" from the lower portion, thus reducing the risk of dribbling.

The flange 32 has a bigger diameter than the ledge 35, which to a smaller degree also applies to the main body 41 of the pipe.

The flexible material in the pipe will however facilitate the fitting of the pipe in the annular member 12. By crumpling the upper end of the pipe 11, as is indicated at 48 in FIG. 7, it is easy to fit this end into the annular member 12. When released, the pipe returns to its circular shape with the groove 34 enclosing ledge 33.

What I claim is:

1. A dispenser for fluids comprising a container and an outlet pipe of flexible material attachable thereto and enclosing a valve member, comprising one big and one small body interconnected by a rod, said container having a substantially planar first end face and an opposite, truncated second end face, said second end face terminating in a first externally threaded neck portion surrounding a first seat for said outlet pipe, means at said first end face for suspending said container in an upturned position with the engaged outlet pipe extending freely therefrom, a restriction in said second end face inside of said threaded neck portion forming a second seat for engagement by the big body of said valve member, said outlet pipe having a top flange mating with said first seat, and an outlet opening at its opposite end, internally formed as a third seat for engagement by said small valve member body, the length of the rod of said valve member being sufficient to hold said big body mainly within said threaded neck portion, when said small body rests upon said third seat, and an internally threaded annular member, mating with said first threaded portion and having a ledge for forcing said top flange against said first threaded portion, said threaded neck portion, inside said first seat having an outwardly directed ledge for internally supporting said outlet pipe, said dispenser further including a transport lid for said container, said lid being a cup-shaped member having an end face and a circular side wall being internally threaded to mate with said threaded neck portion, said end wall having an internal annular bead for engaging said ledge.

2. A dispenser according to claim 1, in which said container is provided with a puncture indication at said first end face.

3. A dispenser according to claim 1, in which said outlet pipe is formed with an annular groove adjacent to said top flange for reception of the ledge of said annular member.

4. A dispenser according to claim 1, in which said threaded neck portion has a substantially uniform wall thickness from said second seat outwards, said big valve member body is spherical and the length of said rod is selected so as to hold said big body with its equator about midway between said first seat and said second seat.

5. A dispenser according to claim 1, in which the suspending means at said first end face includes a groove running across said end face, having open ends at its margin, and a bracket arranged transversely across said groove, about at the gravity center line of said container, said bracket being provided with a hole for engagment by a suspending string.

6. A dispenser for fluids comprising a container and an outlet pipe of flexible material attachable thereto and receiving therein a valve member, comprising one big and one small body interconnected by a rod, said container having a substantially planar first end face and an opposite, truncated second end face, said second end face terminating in a first externally threaded neck portion surrounding a first seat for said outlet pipe, means at said first end face for suspending said container in an upturned position with the engaged outlet pipe extending freely therefrom, a restriction in said second end face inside of said threaded neck portion forming a second seat for engagment by the big body of said valve member, said second seat being formed in one piece with the container, said outlet pipe having a top flange mating with said first seat, and an outlet opening at its opposite end, internally formed as a third seat for engagment by said small valve member body, an internally threaded annular member, mating with said first threaded portion and having a ledge for forcing said top flange against said first seat, said first seat being formed by a radially inwardly turned portion, which defines an opening having a diameter so as to permit introduction of the big valve body into a chamber located within the neck portion and defined by an inner wall of said threaded neck portion, the radially inwardly turned portion and the second seat, the length of the rod of said valve member being sufficient to hold said big body mainly within said chamber, when said small body rests upon said third seat, whereas the chamber forms a flow path around the big valve body, said outlet pipe having a tubular main portion of sufficient length to enable gripping and squeezing of the flexible pipe below the threaded annular member, said valve member being adapted to be influenced indirectly by fluid pressure in the pipe and lifted so as to apply its big valve body against said second seat and remove its small valve body from the third seat upon squeezing of the pipe.

7. A dispenser according to claim 6, in which said container is provided with a puncture indication at said first end face.

8. A dispenser according to claim 6, in which said outlet pipe is formed with an annular groove adjacent to said top flange for reception of the ledge of said annular member.

9. A dispenser according to claim 6, in which said threaded neck portion, inside said first seat, has an outwardly directed ledge for internally supporting said outlet pipe, and further including a transport lid for said container, said lid being a cup-shaped member having an end face and a circular side wall being internally threaded to mat with said threaded neck portion, said end wall having an internal annular bead for engaging said ledge.

10. A dispenser according to claim 6, in which said threaded neck portion has a substantially uniform wall thickness from said second seat outwards, said big valve member body is spherical and the length of said rod is selected so as to hold said bid body with its equator about midway between said first seat and said second seat.

11. A dispenser according to claim 6, in which the suspending means at said first end face includes a groove running across said end face, having open ends at its margin, and a bracket arranged transversely across said groove, about at the gravity center line of said container, said bracket being provided with a hole for engagement by a suspending string.

12. A dispenser according to claim 6, wherein the diameter of the chamber in its widest area is larger than the internal diameter of the adjacent portion of the outlet pipe.

* * * * *